US009876304B2

(12) United States Patent
Issler

(10) Patent No.: US 9,876,304 B2
(45) Date of Patent: Jan. 23, 2018

(54) ELECTRICAL CONNECTING DEVICE AND ELECTRIAL CONTACTING DEVICE

(71) Applicant: Gentherm GmbH, Odelzhausen (DE)

(72) Inventor: Markus Issler, Gersthofen (DE)

(73) Assignee: GENTHERM GMBH, Odelzhausen (DE)

( * ) Notice: Subject to any disclaimer, the term of this patent is extended or adjusted under 35 U.S.C. 154(b) by 0 days.

(21) Appl. No.: 15/302,271

(22) PCT Filed: Apr. 8, 2015

(86) PCT No.: PCT/DE2015/000167

§ 371 (c)(1),
(2) Date: Oct. 6, 2016

(87) PCT Pub. No.: WO2015/154740

PCT Pub. Date: Oct. 15, 2015

(65) Prior Publication Data

US 2017/0033489 A1 Feb. 2, 2017

(30) Foreign Application Priority Data

Apr. 10, 2014 (DE) ..... 10 2014 005 237

(51) Int. Cl.
*H01R 13/62* (2006.01)
*H01R 13/422* (2006.01)
*H01R 13/24* (2006.01)

(52) U.S. Cl.
CPC ..... *H01R 13/422* (2013.01); *H01R 13/24* (2013.01)

(58) Field of Classification Search
CPC ..... H01R 13/422; H01R 13/24
USPC ..... 439/366
See application file for complete search history.

(56) References Cited

U.S. PATENT DOCUMENTS

| | | | | |
|---|---|---|---|---|
| 6,068,519 | A | 5/2000 | Lok | |
| 7,381,086 | B1 | 6/2008 | Gilmore et al. | |
| 2005/0090158 | A1 | 4/2005 | Silva | |
| 2017/0033489 | A1 * | 2/2017 | Issler | H01R 13/24 |

FOREIGN PATENT DOCUMENTS

| | | | | |
|---|---|---|---|---|
| CN | 102214865 | A | 10/2011 | |
| DE | 102012215080 | A1 * | 2/2014 | H01M 2/204 |
| EP | 1523069 | A1 | 4/2005 | |
| WO | 2015/0136358 | A1 | 9/2015 | |

OTHER PUBLICATIONS

International Search Report from the European Patent Office for Application No. PCT/DE2015/000167, dated Aug. 19, 2015.
Written Opinion from the European Patent Office for Application No. PCT/DE2015/000167, dated Aug. 19, 2015.

* cited by examiner

*Primary Examiner* — Abdullah Riyami
*Assistant Examiner* — Nader Alhawamdeh
(74) *Attorney, Agent, or Firm* — The Dobrusin Law Firm, P.C.

(57) ABSTRACT

The present invention relates to a contacting device for producing an electrical contact between at least one first electrical component and at least one second electrical component, said device having a first contacting region and a second contacting region at a distance therefrom.

20 Claims, 2 Drawing Sheets

ELECTRICAL CONNECTING DEVICE AND ELECTRIAL CONTACTING DEVICE

The present invention concerns an electric contacting device according to the preamble of claim 1 and a connecting device 1 produced with it according to the preamble of claim 1.

It is difficult to interconnect a plurality of electric components in such a way as to provide a high current carrying capacity, a secure contacting, a simple mounting and low production costs at the same time. The present invention seeks to make a contribution to this. It proposes a connecting device and a contacting device according to the claims and the following specification.

FIGURES

Figure 1:
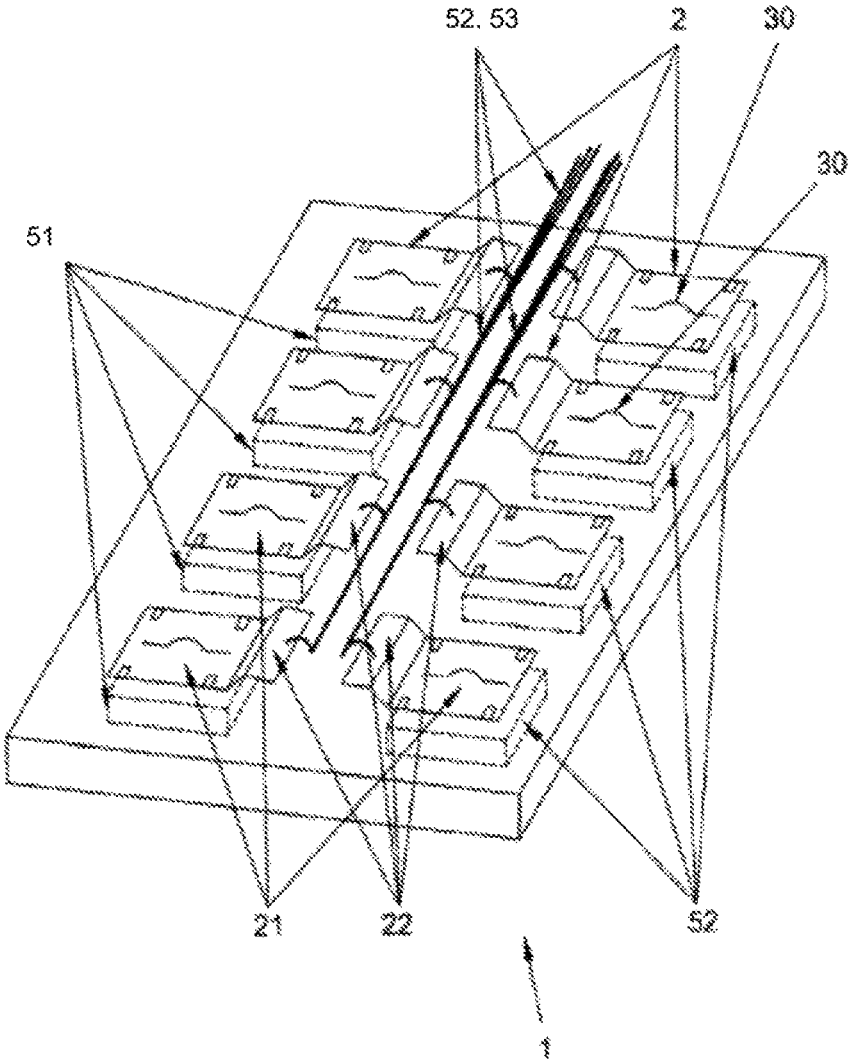

Details of the invention will be explained in the following. These remarks should make the invention more understandable. However, they only have the nature of an example. Of course, one or more features specified in the context of the invention as defined by independent claims may be omitted, modified, or supplemented. The features of different embodiments can also be combined with each other, of course. What is decisive is that the concept of the invention is substantially implemented. When a feature is to be at least partly fulfilled, this includes the fact that this feature is also completely or substantially completely fulfilled. "Substantially" means, in particular, that the implementation permits the achieving of the desired benefit to a recognizable degree. This can mean, in particular, that a corresponding feature is fulfilled at least 50%, 90%, 95% or 99%. If a minimum amount is indicated, then of course it is also possible to use more than this minimum amount. If the number of a component is indicated as being at least one, this also means in particular embodiments with two, three, or some other plurality of components. What is specified for one object can also be applied to the preponderance or the totality of all other similar objects. Unless otherwise indicated, intervals include their end points as well. "A(n)" is intended as an indefinite article and can mean "a single one" or "at least one". In the following, reference is made to:

FIG. 1 Perspective view of an electric connecting device 1 with a plurality of contacting devices 2 in a support 3

Figure 2:
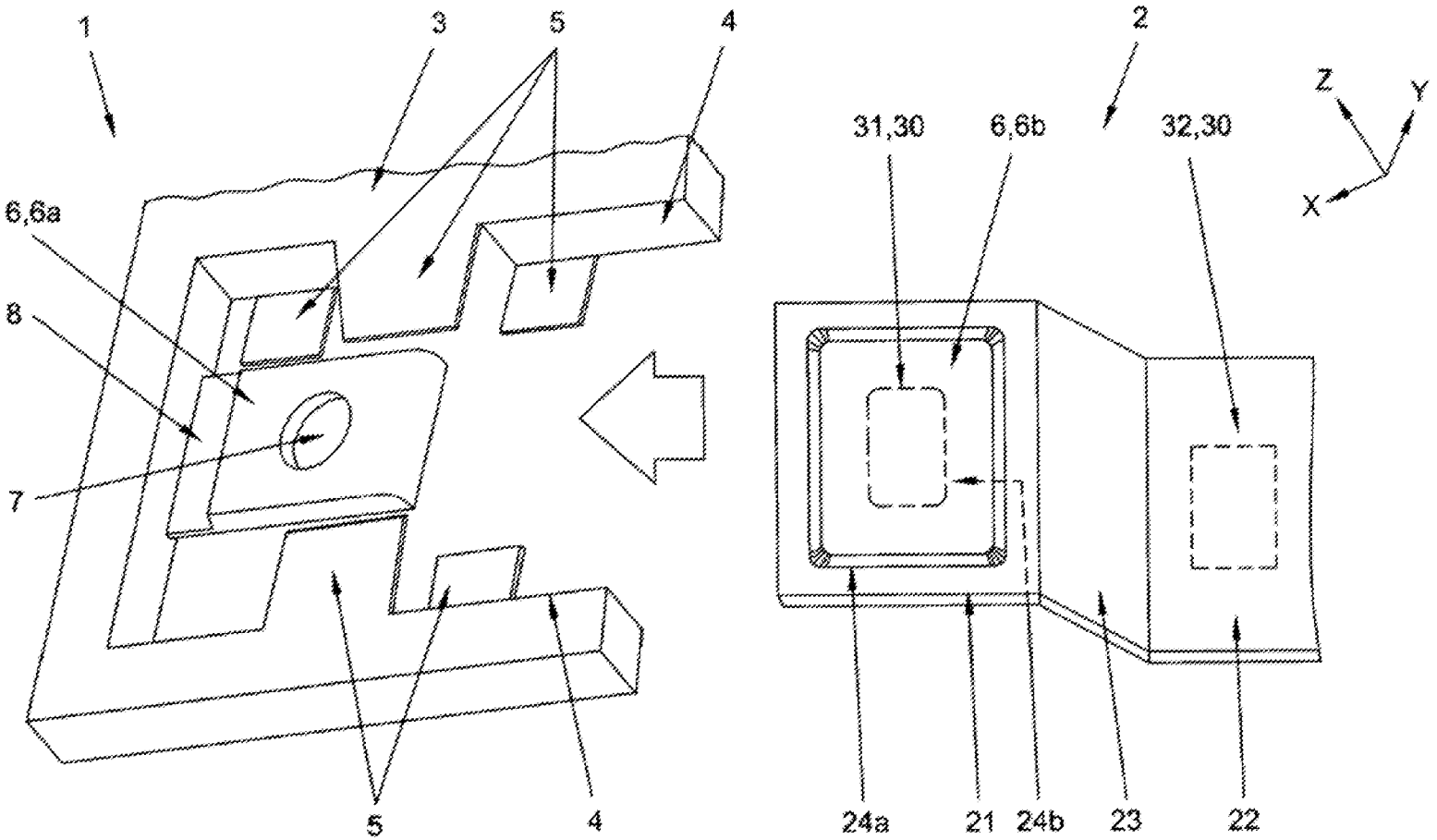

FIG. 2 Perspective detail view showing the fastening of a contacting device 2 with the support 3

SPECIFICATION

The invention comprises at least one of the following components. At least one of the components has one or more of the properties which are stated here as being expedient.

A connecting device 1 is proposed. Connecting device 1 connects two or more electric components. It preferably connects one or more electric components of a first kind to one or more electric components of a second kind. Preferably, the connecting device 1 connects a number of electric conductors or sensors to a number of elementary cells or a second group of electric conductors. Preferably it comprises at least one support 3 and/or at least one contacting device 2. Preferably the connecting device 1 comprises a plurality of contacting devices 2, which are arranged in one or more rows one after the other. It preferably has a flat, rectangular shape, e.g., such as a board. The connecting device 1 can be, e.g., the cover of a car battery.

The contacting device 2 produces an electric contact between a first electric component 51 and a second electric component 52. It is at least partly made of an electrically conductive material, such as a metal like aluminum or copper. The contacting device 2 is, for example, punched out from sheet metal. It is mounted in a support 3 able to move in at least one first direction of play (z). The contacting device 2 is guided or secured at least in a second direction (y) in the support 3. It can be introduced by movement along a displacement direction (x) into its final mounting position in the support 3. The contacting device 2 is profiled, e.g., by embossing or deep drawing. Preferably, the contacting device 2 is self-supporting, i.e., it is not a slack component. Furthermore, it comprises one or more contacting regions 21, 22 or one or more transition regions 23 between such contacting regions 21, 22.

The support 3 is preferably outfitted as a frame and carries at least one contacting device 2. It secures, guides or limits the freedom of movement of the at least one contacting device 2 preferably in one or more directions. Preferably, at least one contacting device 2 has considerably more play in one of three dimensions than in the other two dimensions. The support 3 is preferably designed as an injection molded part. It is preferably made at least partly of plastic (such as polypropylene), an electrically nonconductive material and/or ceramics. The support 3 carries preferably a plurality of contacting devices 2. Preferably, a plurality of contacting devices 2 is arranged in one, two, three or more rows alongside each other. The support 3 carries, secures and organizes cables or wires of a cable harness. Preferably, the support 3 has guide devices 4, limiters 5 and/or detent devices 6.

The guide device 4 guides at least one contacting device 2 while it is being inserted into its final mounting position. The guide device 4 allows a secure movement and displacement along an established Y-position along the X-axis with slight play and slight tolerance. It is formed by walls of the support 3 closely adjacent to the contacting device 2, preferably running parallel to the displacement direction and parallel to the direction of play. The guide device 4 relieves the load on an electric contact or an electric connecting device provided for the latter and/or a welding contact from mechanical stresses at least in a first direction (y) oriented perpendicular to a direction of play (z).

The limiter 5 is preferably made as a single piece with the support 3. It limits the free play of a contacting device 2 in the direction of play (2), in order to make possible a floating mount in the support 3. Together with at least one guide device 4, the support 3 forms a groove into which the contacting device 2 can be shoved. Preferably, at least one limiter 5 is provided above and below a contacting device 2 in the final mounting position (relative to the direction of play). The limiter 5 is formed preferably by a projection, tongue, or rod and is preferably made from the same material as the support 3. It is preferably shorter in the inserting direction than the contacting device, preferably also shorter than the inserted segment of the latter. Preferably, at least one limiter 5 situated above the contacting device 2 has no overlapping region with a limiter situated below the contacting device (viewing along the direction of play (z)), simplifies the casting process). The play in the z-direction is preferably between 0.5 mm and 5 mm, preferably between 1 and 2 mm.

The detent device 6 arrests the contacting device 2 after it is shoved into the support 3 in the final mounting position, thus preventing its unintentional removal from this position. The detent device 6 allows free play in the direction of play (z), e.g., by a spring loading of the detent device 6 and/or the contacting device 2. If need be, it allows (less) free play in the other directions (x, y), e.g., by allowing a relative displacement between contacting device 2 and/or detent device 6 on the one hand and support 3 and/or detent device 6 on the other hand. The detent device 6 can be arranged at least partly on a contacting device 2. It is preferably arranged at least partly on the support 3. The detent device 6 relieves the load on an electric contact or a connecting device provided for this and/or a welding contact from mechanical stresses at least in a second direction (x) oriented perpendicular to a direction of play (z). The detent device 6 has at least one locking device 6*a* and/or one mating piece 6*b*.

The locking device 6*a* is preferably arranged on the support 3. It is preferably outfitted with a spring device 8, in order to allow for the locking of the locking device 6*a* upon introducing a contacting device 2 into its final mounting position, in that the locking device 6*a* engages in a corresponding mating piece 6*b* on the contacting device 2. Preferably, the locking device 6*a* is at least partly made from the same material as the support 3. It is preferably prestressed by shoving in the contacting device 2. The locking device 6*a* is preferably flat and oriented parallel to the support plane. It is preferably made from a single piece with the support 3 and preferably has an elevation, such as one in the form of a detent lug. The locking device 6*a* has a depression (not shown), in order to receive a mating piece (not shown).

The first contacting region 21 is a region of a contacting device 2 in which the contacting device 2 is electrically connected to a first electric component 51. It is preferably at least partly sheetlike or flat, preferably being level. The first contacting region 21 is preferably made of metal, especially copper or aluminum. It has a contact surface 24, an elevation 24*a*, a depression 24*b* and/or a welding access 7. The welding access 7 affords access to the contacting region 21, 22 from a covered, held side for the welding tool and it has the shape of a recess. It has a welding zone 31 or contact site 30.

The second contacting region 22 is a region of a contacting device 2 in which the contacting device 2 is electrically connected to a further electric component 52, 53. It is preferably at least partly sheetlike, flat, and/or level. The second contacting region 22 is preferably made of the same material as the first contacting region 21, preferably as a single piece with it. It has a welding zone 32 or contact site 30.

The transition region 23 connects the first contacting region 21 to the second contacting region 22. It is preferably designed as a self-supporting component, i.e., not slack. Preferably, the transition region 23 is elastically resilient, to allow an automatically reversible deflecting of the first contacting region 21 relative to the second contacting region 22. The transition region 23 is preferably permanently deformable, in order to make possible a not automatically restoring deflection of the first contacting region 21 relative to the second contacting region 22 and to hold the first contacting region 21 in this altered position permanently, i.e., with no time limit. Preferably, the transition region 23 is level at least for a section and angled relative to the first contacting region 21 and/or the second contacting region 22, preferably both, preferably in opposite direction, preferably at the same angle. The transition region 23 is preferably curved at least for a section, having one or more bending radii, preferably with at least two curvatures of opposite orientation (not shown). It equalizes relative movements between the two contacting regions 21, 22 or tolerance differences between contacting components in reversible or irreversible manner.

The contact surface 24 is preferably spaced away from at least one edge of a contacting region 21, 22, preferably from all edges, in order to enable a lateral supporting in the edge regions, e.g., by means of guide device 4 and/or limiter 5. It is preferably level, preferably larger than a welding zone 31, 32. The contact surface 24 is arranged preferably at different height level than the edges, e.g., on an elevation 24*a* and/or a depression 24*b*. This profiling of the contacting region 21, 22 produces a greater stiffness of the contacting region. The contact surface 24 is preferably formed by embossing or deep drawing from the contacting region 21, 22. Together with its edge, it forms a truncated cone, a flattened pyramid, or a tub shape. The elevation 24*a* and/or depression 24*b* can serve as a mating piece 6*b* for a locking device 6*a* and enable a precise positioning of the contacting device 2.

The contact site 30 is provided on a contact surface 24 and/or a contacting region 21, 22. A contacting of a contacting device 2 with another electric component 51, 52, 53 is provided here. The contact site 30 is preferably welded with ultrasound, laser, or electricity. It is glued conductively as an additional option. The contact site 30 is smaller in at least two directions than a contact surface 24 and/or a contacting region 21, 22, in order to make it as easy as possible to position an electric component 51, 52, 53. It has maximum dimensions of 80% of the dimensions of a contact surface 21 or a contacting region 21, 22, preferably at most 60%, at least in one direction. In this way, the welding region is freed up from positioning tasks. The contact site 30 is realized by welding zones 31, 32.

Preferably, one group of electric components 51 of a first kind is electrically connected to a group of electric components 52 of another kind. Preferably, the connecting device 1 creates an electric connection with at least one component 53 of another kind. Preferably, both components 52 of the second kind and components 53 of the third kind are contacted with the aid of identical contacting devices 2 (simplifies the structure and reduces the number of part types).

Electric components 51 of the first kind are, e.g., current consumers, a charging station or its contact terminals, an electric control device or its connection contacts, contact cables, etc. Components 52 of the second kind are, e.g., elementary cells of a battery, Peltier elements, PTC heating components, Seebeck elements, LED lights, display panels, cathodes, etc. Components 53 of the third kind are, e.g., control sensors for components of the second kind, functional elements operating opposite to components of the second kind, such as Seebeck elements, anodes, or Peltier elements, dampers for components of the second kind (such as vibration compensators for motors) or adjustment or control devices for them.

Electric component means in particular:

- electric conductors such as cables, wires, contact plates, electrodes, stranded conductors or the like
- electric consumers such as light bulbs, electric motors, chargeable power storages, heating appliances, etc.
- electric power sources like generators, charged power storages such as electrochemical voltage sources, storage batteries, etc.

Electric components of the same kind means a number of components whose function and/or effect is equal or similar. Preferably, their mode of operation and design is also identical or similar.

The present connecting device can preferably be used to connect a plurality of elementary cells of a car battery to an alternator and/or a plurality of electric consumers in the vehicle. The contacting cables used are preferably led through or inserted in/on the support 3.

LIST OF REFERENCE NUMBERS

1 Connecting device
2 Contacting device
3 Support
4 Guide device
5 Limiter
6 Detent device
6*a* Locking device
6*b* Mating piece
7 Welding access
8 Spring device
21, 22 Contacting regions
23 Transition region
24 Contact surface
24*a* Elevation
24*b* Depression
30 Contact site
31, 32 Welding zone
51, 52, 53 Component
(x) Displacement direction
(y) Second direction
(z) First direction of play

The invention claimed is:

1. An electric connecting device comprising:

i) a contacting device for making an electric contact between at least a first electric component and at least a second electric component the contacting device comprising:

a) a first contacting region; and b) a second contacting region at a distance therefrom; and ii) a support;

wherein the contacting device is held within the support; wherein the first contacting region is held in a self-supporting position relative to the second contacting region and wherein the first contacting region is able to move relative to the second contacting region at least in one direction of play;

wherein the support includes a frame and the contacting device is adapted to slide into the frame.

2. The electric connecting device according to claim 1, wherein the first contacting region lies on a first level, the second contacting region lies on a second level, and the first level and the second level lie at different heights from each other in regard to a direction of play, and/or the first level and the second level are arranged tilted relative to each other.

3. The electric connecting device according to claim 2, wherein the first contact region and the second contacting region at least partly overlap looking down from a direction of play and a transition region interconnecting the first contacting region and second contacting region describes a turning of the contacting device by at least 150° in total.

4. An electric connecting device comprising:

a. at least one contacting device including a first contacting region and a second contact region at a distance from the first contacting region; and b. at least one support with a frame;

wherein the support carries at least one contacting device;

wherein the at least one contacting device is adapted to slide into the frame and is positioned within the frame by one or more guide devices and one or more limiters, placing the at least one contacting device in a final mounting position.

5. The electric connecting device according to claim 4, wherein the at least one contacting device is mounted movably with free play in at least in one direction of play in the support.

6. The electric connecting device according to claim 4, wherein the connecting device comprises: at least two contacting devices, which connect one or more first components to at least two contact sites of one or more second components, one of the two contact sites is coordinated with one of the two contacting devices, the two contact sites are coordinated with identical contacting regions, and the two contact sites can be arranged at different level from each other in regard to the direction of play in order to equalize tolerances.

7. The electric connecting device of claim 1, wherein the contacting device is positioned within the frame by one or more guide devices and one or more limiters, placing the contacting device in a final mounting position.

8. The electric connecting device of claim 4, wherein the at least one support is made of an electrically nonconductive material.

9. The electric connecting device of claim 4, wherein the one or more guide devices secure movement and displacement of the at least one contacting device in a Y-position along an X-axis.

10. The electric connecting device of claim 4, wherein the one or more limiters are made as a single piece with the support;

wherein the one or more limiters is a projection made from the same material as the at least one support.

11. The electric connecting device of claim 5, wherein the one or more limiters limits free play of the at least one contacting device in a direction of play, creating a floating mount in the support.

12. The electric connecting device of claim 4, wherein the electric connecting device includes a detent device, which arrests the at least one contacting device after it is inserted into the at least one support to prevent unintentional removal of the at least one contacting device from the final mounting position;

wherein the detent device includes at least one locking device and at least one mating piece;

wherein the at least one locking device is located on the at least one support and the mating piece is located on the at least one contacting device.

13. The electric connecting device of claim 12, wherein the at least one locking device includes a spring device;

wherein the spring device is biased by the at least one mating piece when the contacting device is pushed into the at least one support.

14. The electric connecting device of claim 13, wherein the at least one contacting device includes a first contact region and a second contact region;

wherein the first contact region includes a first contact site and the second contact region includes a second contact site;

wherein the first contact region contacts a first electric component and the second contact region contacts at least one other electric component.

15. The electric connecting device of claim 14, wherein the first contact region includes a contact surface, the contact surface includes an elevation and a depression;

wherein the contact surface is spaced away from at least one edge of the first contact region and the elevation and the depression are at different height levels than the at least one edge, the elevation being above and the depression being below.

16. The electric connecting device of claim 15, wherein the elevation and the depression are the mating piece for the locking device, enabling precise positioning of the contacting device.

17. The electric connecting device of claim 15, wherein the first contact site and the second contact site are smaller in at least two directions than the first contact region and the second contact region;

wherein the first contact site and the second contact site have a maximum dimension of 80 percent of the first contact region and the second contact region.

18. The electric connecting device of claim 8, wherein the at least one support is at least partially made of plastic.

19. The electric connecting device of claim 17, wherein the maximum dimension of the first contact site and the second contact site is at most 60 percent.

20. The electric connecting device according to claim 2, wherein the connecting device comprises: at least two contacting devices, which connect one or more first components to at least two contact sites of one or more second components, one of the two contact sites is coordinated with one of the two contacting devices, the two contact sites are coordinated with identical contacting regions, and the two contact sites can be arranged at different level from each other in regard to the direction of play in order to equalize tolerances.

* * * * *